US008618734B2

(12) United States Patent
Buttstaedt et al.

(10) Patent No.: US 8,618,734 B2
(45) Date of Patent: Dec. 31, 2013

(54) HIGH-PRESSURE DISCHARGE LAMP WITH IGNITION AID

(75) Inventors: Johannes Buttstaedt, Falkensee (DE); Stefan Lichtenberg, Falkensee (DE)

(73) Assignee: OSRAM AG, Munich (DE)

( * ) Notice: Subject to any disclaimer, the term of this patent is extended or adjusted under 35 U.S.C. 154(b) by 0 days.

(21) Appl. No.: 13/809,605

(22) PCT Filed: Jul. 8, 2011

(86) PCT No.: PCT/EP2011/061706

§ 371 (c)(1),
(2), (4) Date: Jan. 11, 2013

(87) PCT Pub. No.: WO2012/007405

PCT Pub. Date: Jan. 19, 2012

(65) Prior Publication Data

US 2013/0113371 A1 May 9, 2013

(30) Foreign Application Priority Data

Jul. 13, 2010 (DE) ..... 10 2010 031 280

(51) Int. Cl.
*H01J 17/44* (2006.01)
*H01J 61/54* (2006.01)

(52) U.S. Cl.
USPC ..... 313/594; 313/567; 313/601

(58) Field of Classification Search
USPC ..... 313/25–27, 111–117, 317, 313/318.01–318.09, 483–493, 567–577, 313/623, 627–643, 594, 601; 445/26
See application file for complete search history.

(56) References Cited

U.S. PATENT DOCUMENTS

| | | | |
|---|---|---|---|
| 4,721,888 | A | 1/1988 | Proud et al. |
| 4,812,714 | A | 3/1989 | Keeffe et al. |
| 4,818,915 | A | 4/1989 | Zaslavsky et al. |
| 4,987,344 | A | 1/1991 | Zaslavsky et al. |
| 5,001,360 | A | 3/1991 | Hartwig |
| 5,323,087 | A | 6/1994 | Zaslavsky et al. |
| 5,323,091 | A | 6/1994 | Morris |
| 5,397,259 | A | 3/1995 | Zaslavsky et al. |

(Continued)

FOREIGN PATENT DOCUMENTS

| | | | |
|---|---|---|---|
| EP | 1162865 | A2 | 12/2001 |
| JP | 2010244831 | A | 10/2010 |
| NL | 6501325 | A | 8/1966 |
| WO | 2010004472 | A2 | 1/2010 |

OTHER PUBLICATIONS

English language abstract of JP 2010244831 A dated Oct. 28, 2010.

*Primary Examiner* — Donald Raleigh

(57) ABSTRACT

A high-pressure discharge lamp having an ignition aid is provided. The discharge lamp may include: a discharge vessel consisting of ceramic or quartz glass which is sealed at two ends and which is accommodated in an outer bulb which is likewise sealed at two ends, the discharge vessel having two ends in which electrodes are fastened, two power supply lines holding the discharge vessel in the outer bulb, a UV enhancer with a single electrode as ignition aid being accommodated in the outer bulb, wherein the UV enhancer is positioned in the vicinity of a second end of the discharge vessel, while a feed line is routed from the first power supply line along the discharge vessel and is connected to the UV enhancer, the feed line being capacitively coupled to the first power supply line, the UV enhancer being installed between the feed line and the second power supply line.

10 Claims, 3 Drawing Sheets

(56) References Cited

U.S. PATENT DOCUMENTS

| | | | |
|---|---|---|---|
| 5,757,137 | A | 5/1998 | Zhu |
| 5,811,933 | A | 9/1998 | Van Den Nieuwenhuizen et al. |
| 5,909,082 | A | 6/1999 | Speaker et al. |
| 5,942,840 | A | 8/1999 | Steere et al. |
| 5,959,404 | A | 9/1999 | Nortrup et al. |
| 5,990,599 | A | 11/1999 | Jackson et al. |
| 6,198,223 | B1 | 3/2001 | Scholz |
| 6,806,646 | B2 | 10/2004 | Lapatovich et al. |
| 7,301,283 | B1 | 11/2007 | Callahan et al. |
| 2003/0127985 | A1 | 7/2003 | Okamoto et al. |
| 2006/0255741 | A1 | 11/2006 | Ishigami et al. |

HIGH-PRESSURE DISCHARGE LAMP WITH IGNITION AID

RELATED APPLICATIONS

The present application is a national stage entry according to 35 U.S.C. §371 of PCT application No.: PCT/EP2011/061706 filed on Jul. 8, 2011, which claims priority from German application No.: 10 2010 031 280.0 filed on Jul. 13, 2010.

TECHNICAL FIELD

Various embodiments are based on a high-pressure discharge lamp. Such lamps are e.g. high-pressure discharge lamps for general lighting.

BACKGROUND

The combination of metal ignition aids with a discharge vessel consisting of quartz glass or of sodium-permeable ceramic has until now only been possible with significant restrictions since the metal parts guided past the discharge vessel cause the sodium to diffuse out of the discharge vessel. In order to avoid this emergence of sodium, caused by metal ignition aids, some sometimes complex countermeasures have been proposed. For example, the galvanic contact can be isolated after starting by bimetallic-element switches, for example U.S. Pat. No. 5,757,137, or external switches, for example EP-A 1 162 865, in order to prevent the emergence of sodium. It is also known from U.S. Pat. No. 5,001,360 to plug a ceramic tube over the power supply line running parallel to the burner in order to prevent photoionization from the feed line. The problem with this consists in that the entire feed line is not shielded via the ceramic tube and the remaining free parts of the feed line can nevertheless cause the emergence of sodium as a result of photoionization.

SUMMARY

Various embodiments provide a high-pressure discharge lamp which can be started using simple, inexpensive means.

This applies in particular to high-pressure sodium lamps or else metal halide lamps, the material of the discharge vessel being ceramic or quartz glass and containing sodium as fill constituent.

Particularly advantageous configurations are given in the dependent claims.

For starting krypton-85-free HID lamps with a base at two ends and with a sodium-containing fill and a discharge vessel, through which sodium can diffuse, in particular in the case of a discharge vessel consisting of quartz glass, until now there has been no solution which enables reliable lamp starting without any considerable delay times and does not substantially influence the life or the lighting engineering data of the lamp in comparison with krypton-85-containing lamps.

In order to start HID lamps, free electrons need to be produced in the discharge vessel. Until now, this has been achieved by radioactive krypton-85 in the fill gas. Field increases as a result of metal ignition aids (for example U.S. Pat. No. 6,198,223) are also possible in particular in the case of ceramic without sodium diffusion. A further solution is UV radiation (for example quartz technology: U.S. Pat. No. 4,721,888; U.S. Pat. No. 4,812,714; U.S. Pat. No. 4,818,915; U.S. Pat. No. 4,987,344; U.S. Pat. No. 5,323,087; U.S. Pat. No. 5,323,091; U.S. Pat. No. 5,397,259; U.S. Pat. No. 5,959,404; U.S. Pat. No. 5,990,599; U.S. Pat. No. 6,806,646; U.S. Pat. No. 7,301,283; ceramic technology: U.S. Pat. No. 5,811,933; U.S. Pat. No. 5,942,840; U.S. Pat. No. 6,806,646).

In the case of UV enhancers with two electrodes, further components, such as a capacitor (U.S. Pat. No. 4,987,344) or even more complex drive systems (U.S. Pat. No. 4,721,888), for example, are necessary in order to limit the current through the UV enhancer. Therefore, UV enhancers which have only one electrode and use a dielectrically impeded discharge have been generally accepted. These UV enhancers are relatively favorable and direct contact can be made with these UV enhancers (without any additional component parts) in the case of sodium-free lamps or discharge vessels without sodium diffusion. The counterelectrode is fitted to the vessel of the UV enhancer from the outside. The abovementioned patents contain exemplary embodiments in this regard. Simple solutions are possible, such as the application to the wire or else more complex solutions such as a metal ring. U.S. Pat. No. 5,990,599 even introduces an additional outer bulb beneath a metal ring.

None of the patents from the prior art is directed at lamps with a base at two ends with possible emergence of sodium from the burner. For starting with a UV enhancer, in which only one electrode is sealed in with a pinch seal, a contact needs to be guided past the burner, which results in the emergence of sodium from the burner in the case of galvanic contact with a power supply line.

Reliable starting of HID lamps with a base at two ends and with a two-ended discharge vessel consisting of quartz glass, in particular with a sodium-containing fill, is possible as a result of capacitive coupling of the power supply line for the dielectrically impeded UV enhancer.

Essential features of the invention in the form of an enumerated list are as follows:

1. A high-pressure discharge lamp comprising an ignition aid, comprising a discharge vessel consisting of ceramic or quartz glass which is sealed at two ends and which is accommodated in an outer bulb which is likewise sealed at two ends, the discharge vessel having two ends in which electrodes are fastened, two power supply lines holding the discharge vessel in the outer bulb, a UV enhancer with a single electrode as ignition aid being accommodated in the outer bulb, characterized in that the UV enhancer is positioned in the vicinity of a second end of the discharge vessel, while a feed line is routed from the first power supply line along the discharge vessel and is connected to the UV enhancer, the feed line being capacitively coupled to the first power supply line, the UV enhancer being installed between the feed line and the second power supply line.
2. The high-pressure discharge lamp as described under item 1, wherein the single electrode of the UV enhancer is also capacitively coupled to the second power supply line.
3. The high-pressure discharge lamp as described under item 1, wherein the capacitive coupling between the feed line and the first power supply line is implemented by coaxial routing of the two conductors, semi-coaxial routing, or by parallel routing of the two conductors, or by areal extension and parallel routing of the two conductors.
4. The high-pressure discharge lamp as described under item 1, wherein the discharge vessel is manufactured from ceramic, with two capillaries at the two ends, the feed line being sintered onto the two capillaries and the discharge vessel as a conductive track, the capacitive coupling being performed with respect to the bushing running in each case in the capillary.

5. The high-pressure discharge lamp as described under item 4, wherein a conductor extends from the track in the direction of the UV enhancer.
6. The high-pressure discharge lamp as described under item 4, wherein an additional coupling capacitor is introduced between the track and the first power supply line.
7. The high-pressure discharge lamp as described under item 4, wherein that end of the UV enhancer which is in dielectric contact is fitted in the direct vicinity of the track on the second capillary.
8. The high-pressure discharge lamp as described under item 1, wherein a second UV enhancer is fitted to the first capillary in each case the dielectric end of the UV enhancer pointing in the direction of the power supply line, and the feed line making contact with the one electrode of each of the two UV enhancers, with the result that the capacitive coupling is implemented directly by the two UV enhancers.
9. The high-pressure discharge lamp as described under item 1, wherein the discharge vessel has a sodium-containing fill.
10. The high-pressure discharge lamp as described under item 1, wherein the discharge vessel is manufactured from quartz glass.

BRIEF DESCRIPTION OF THE DRAWINGS

The invention will be explained in more detail below with reference to a plurality of exemplary embodiments. In the figures.

DETAILED DESCRIPTION

The following detailed description refers to the accompanying drawings that show, by way of illustration, specific details and embodiments in which the invention may be practiced.

Figure 1:
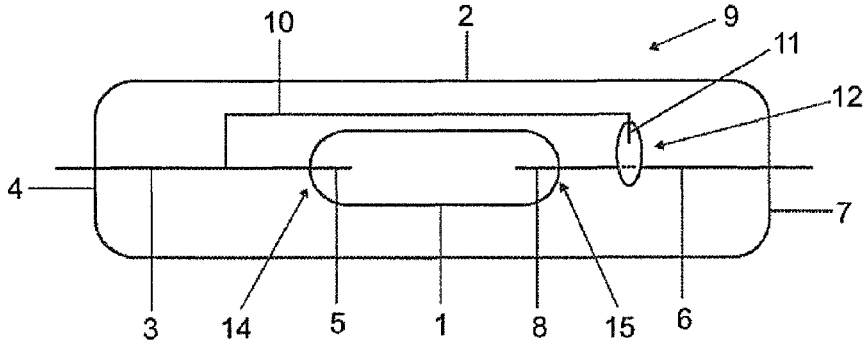
FIG 1 (Prior art)
FIG. 1 shows a high-pressure discharge lamp with an ignition aid, in accordance with the prior art.

FIG. 1 shows a schematic of a metal halide lamp 9, in which a discharge vessel 1 consisting of quartz glass is contained in an outer bulb 2 consisting of quartz glass. The two vessels are cylindrical vessels which are sealed at two ends. A first power supply line 3 is sealed off both in a first end 4 of the outer bulb and in a first end 14 of the discharge vessel and leads to a first electrode 5 in the discharge vessel 1. A second power supply line 6 is sealed off both in a second end 7 of the outer bulb and in a second end 15 of the discharge vessel and leads to a second electrode 8 in the discharge vessel 1.

A feed line 10 passes from the first power supply line 3 along the discharge vessel up to the height of the second power supply line 6. There, it ends at the single electrode 11 of a UV enhancer 12. This UV enhancer is coupled dielectrically to the second power supply line 6.

The problem with the emergence of sodium is known from metal ignition aids. In this case, the galvanic contact is isolated after starting by bimetallic-element switches (for example U.S. Pat. No. 5,757,137) or external switches (for example EP 1162865) in order to prevent the emergence of sodium. It is known to plug a ceramic tube over the power supply line running parallel to the burner in order to prevent photoionization from the feed line. In this case, the problem consists in that the entire feed line is not shielded via the ceramic tube and the remaining free parts of the feed line can cause the emergence of sodium as a result of photoionization.

Figure 2:
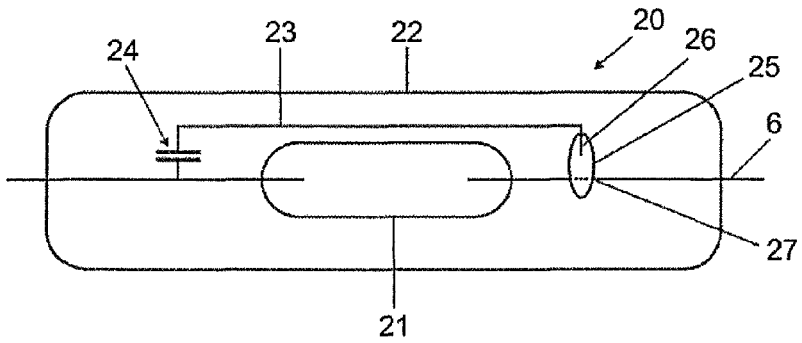
FIG. 2 shows a high-pressure discharge lamp with an ignition aid, first exemplary embodiment.
Figure 3:
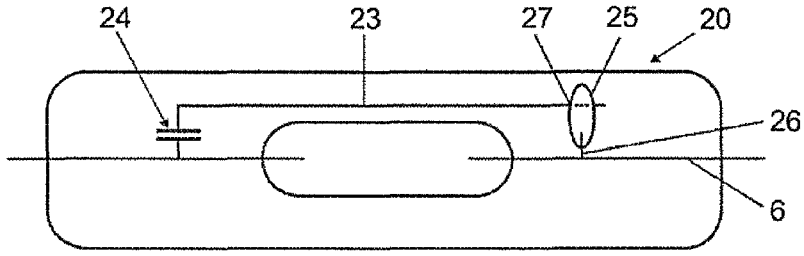
FIG. 3 shows a high-pressure discharge lamp with an ignition aid, second exemplary embodiment.

FIG. 2 shows the design of a metal halide lamp 20 according to the invention in a very schematized view. It has a discharge vessel 21 consisting of quartz glass, which is accommodated in an outer bulb 22 consisting of quartz glass. The design differs from the prior art in that the emergence of sodium is not possible. The reason for this is that the feed line 23 routed past the discharge vessel is only coupled capacitively via the capacitance 24 and not galvanically, as in FIG. 1. The entire power supply line formed by the feed line 23 for the UV enhancer 25 is thus also galvanically decoupled and cannot cause even partial photoemission and emergence of sodium as in the known solution using a ceramic tube. The contact with the single electrode 26 of the UV enhancer can be aligned in both directions: both aligned with the electrode toward the capacitively coupled feed line 23 (FIG. 2) and aligned toward the feed line 23 (FIG. 3). The second electrode of the UV enhancer is dielectrically coupled to the respective feed line or power supply line, denoted by reference numeral 27.

Both types of contact for the single electrode of the UV enhancer 25 is always intended in the following exemplary embodiments, even if only one form is represented.

Figure 4:
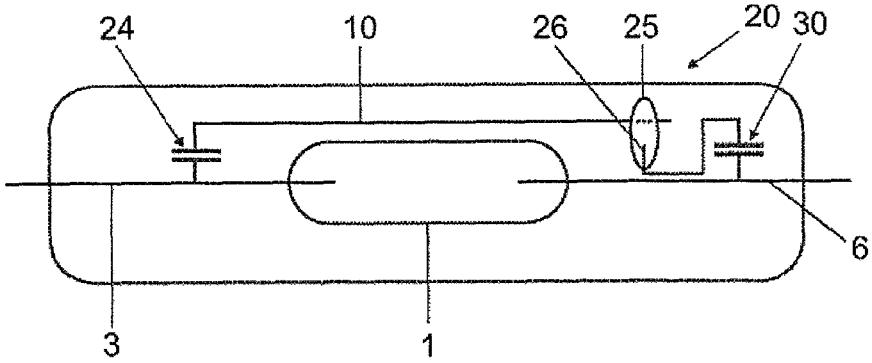
FIG. 4 shows a high-pressure discharge lamp with an ignition aid, third exemplary embodiment.

FIG. 4 shows a further exemplary embodiment, in which, in addition to the circuit shown in FIG. 3, the electrode 26 of the UV enhancer 25 is also capacitively coupled to the second power supply line 6 via a further capacitance 30.

The capacitive coupling can be performed in particular with the aid of discrete components such as a capacitor. Other forms of capacitive coupling are likewise possible as a result of a targeted geometric arrangement of the conductors/contacts (for example parallel or coaxial routing possibly with suitable dielectrics). Some examples in this regard are shown in FIG. 5. The selection of the dielectrics is limited owing to the high temperature loading possible. In this case, materials of glass and ceramic are possible. Examples of cross sections of various geometries for implementing capacitive coupling are possible.

Figures 5A, 5B, 5C, 5D:
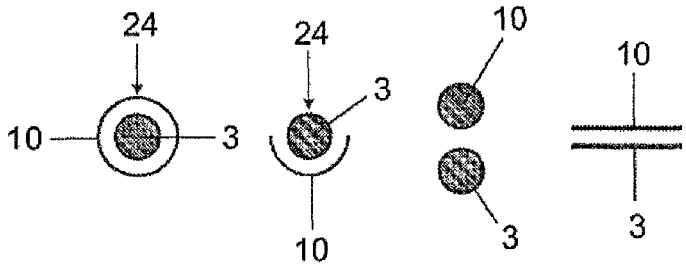
FIG. 5 shows details of exemplary embodiments of capacitive ignition aids.

FIG. 5*a* shows a coaxial arrangement of the first power supply line 3 and the feed line 10 for implementing the capacitive coupling 24.

FIG. 5*b* shows a coaxial arrangement of the first power supply line 3 and the feed line 10 for implementing the capacitive coupling 24, with the power supply line 3 being only half surrounded by the feed line 10.

FIG. 5*c* shows simple parallel routing of the first power supply line 3 and the feed line 10.

FIG. 5*d* shows simple parallel routing of the first power supply line 3 and the feed line 10, with the two being in the form of flat films, at least in sections, with the result that particularly intensive capacitive coupling is possible.

The possibility of connecting further components, such as resistors or inductances, for example, in series with a capacitance is not ruled out either. However, these components can weaken the capacitive effect.

Inductive coupling, such as by means of coupled coils or transformers, for example, is not possible since, at the time of starting, no conduction current flows through the power supply line or the discharge vessel. If such components are intended to be used, an effect as ignition aid needs to be performed by parasitic capacitances.

Figure 6:
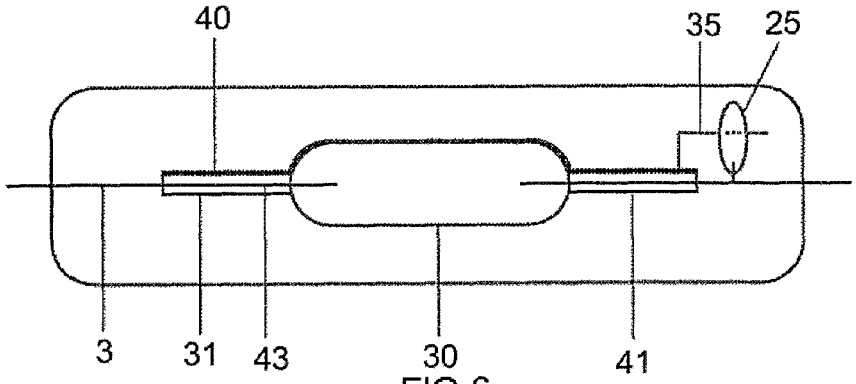
FIGS. 6 to 9 show a high-pressure discharge lamp with an ignition aid, further exemplary embodiments.

In FIG. 6, a galvanically decoupled feed line 40 is sintered onto a ceramic discharge vessel 30. Capacitive coupling takes place owing to the parallel routing of the sintered feed line 40 on a first capillary 31 to the first power supply line 3, or a bushing 43 fitted thereon to the discharge vessel in the capillary 31 on the first side of the discharge vessel. The sintered feed line 40 reaches as far as the other side of the discharge vessel, where a second capillary 41 is fitted where the UV enhancer 25 is also fitted. A contact 35 is routed from this feed line toward the UV enhancer 25. The introduction of the UV enhancer takes place as shown in FIG. 2 or 3. In order to increase the capacitive coupling, widening of the feed line on the capillary by using rings around the capillary or flat sintered portions is also possible as is known per se.

Figure 7:
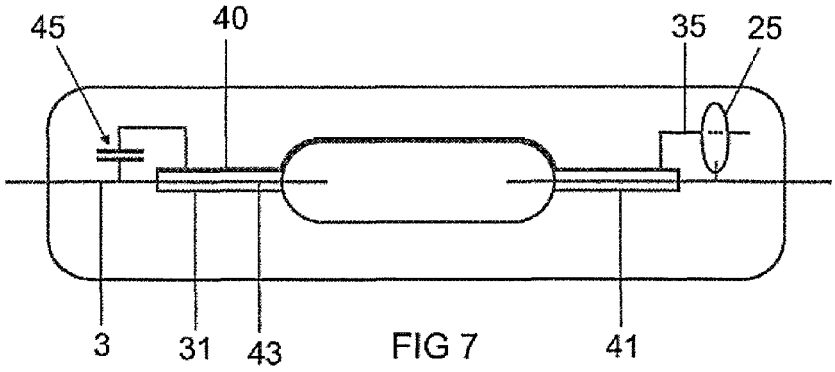

FIG. 7 shows an exemplary embodiment similar to that in FIG. 6 with an additional capacitance 45 in order to intensify the capacitive coupling.

Figure 8:
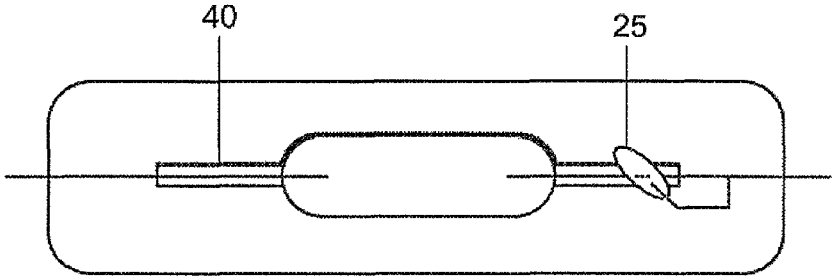

In FIG. 8, the sintered feed line 40 is used directly as an external, dielectrically impeded electrode for the UV enhancer 25. The geometric arrangement in this regard needs to be such that the sintered section at the end of the feed line 40 comes as close to the enveloping vessel of the UV enhancer as possible. In this way, no separate contact with the sintered feed line as in FIG. 7 is necessary.

Figure 9:
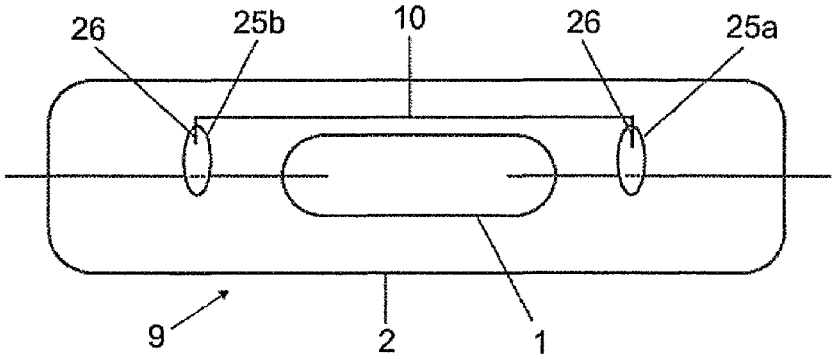

In FIG. 9, two UV enhancers 25*a* and 25*b*, each having a single electrode 26, in each case one on each side of the discharge vessel, are used. The capacitive coupling takes place in this case by virtue of the two UV enhancers themselves. Both arrangements shown in FIGS. 2 and 3 are also conceivable here.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The particular advantage of the novel arrangement consists in that starting without any time delay is achieved. The emergence of sodium from the discharge vessel is suppressed by capacitive coupling of the feed line, which is routed past the discharge vessel, in an inexpensive manner.

The invention claimed is:

1. A high-pressure discharge lamp comprising an ignition aid, comprising:

a discharge vessel consisting of ceramic or quartz glass which is sealed at two ends and which is accommodated in an outer bulb which is likewise sealed at two ends, the discharge vessel having two ends in which electrodes are fastened, two power supply lines holding the discharge vessel in the outer bulb, a UV enhancer with a single electrode as ignition aid being accommodated in the outer bulb, wherein the UV enhancer is positioned in the vicinity of a second end of the discharge vessel, while a feed line is routed from the first power supply line, at the first end of the discharge vessel, along the vessel, towards the second end of the discharge vessel and is connected to the UV enhancer, the feed line being capacitively coupled to the first power supply line, the UV enhancer being installed between the feed line and the second power supply line.

2. The high-pressure discharge lamp as claimed in claim 1, wherein the single electrode of the UV enhancer is also capacitively coupled to the second power supply line.

3. The high-pressure discharge lamp as claimed in claim 1, wherein the capacitive coupling between the feed line and the first power supply line is implemented by one of the following:

coaxial routing of the two conductors, semi-coaxial routing, parallel routing of the two conductors, and areal extension and parallel routing of the two conductors.

4. The high-pressure discharge lamp as claimed in claim 1, wherein the discharge vessel is manufactured from ceramic, with two capillaries at the two ends, the feed line being sintered onto the two capillaries and the discharge vessel as a conductive track, the capacitive coupling being performed with respect to the bushing running in each case in the capillary.

5. The high-pressure discharge lamp as claimed in claim 4, wherein a conductor extends from the track in the direction of the UV enhancer.

6. The high-pressure discharge lamp as claimed in claim 4, wherein an additional coupling capacitor is introduced between the track and the first power supply line.

7. The high-pressure discharge lamp as claimed in claim 4, wherein that end of the UV enhancer which is in dielectric contact is fitted in the direct vicinity of the track on the second capillary.

8. The high-pressure discharge lamp as claimed in claim 1, wherein a second UV enhancer is fitted to the first capillary in each case the dielectric end of the UV enhancer pointing in the direction of the power supply line, and the feed line making contact with the one electrode of each of the two UV enhancers, with the result that the capacitive coupling is implemented directly by the two UV enhancers.

9. The high-pressure discharge lamp as claimed in claim 1, wherein the discharge vessel has a sodium-containing fill.

10. The high-pressure discharge lamp as claimed in claim 1, wherein the discharge vessel is manufactured from quartz glass.

* * * * *